US006070499A

United States Patent [19]

Wisbey

[11] Patent Number: 6,070,499

[45] Date of Patent: Jun. 6, 2000

[54] RATCHET WRENCH HAVING TWO MODES OF RECIPROCATING MANUAL INPUT

[76] Inventor: James Harry Wisbey, 9 Thirkleby Close, Slough, Berkshire, SL1 3XF, United Kingdom

[21] Appl. No.: 08/875,148

[22] PCT Filed: Dec. 11, 1995

[86] PCT No.: PCT/GB95/02879

§ 371 Date: Jun. 23, 1997

§ 102(e) Date: Jun. 23, 1997

[87] PCT Pub. No.: WO96/20071

PCT Pub. Date: Jul. 4, 1996

[30] Foreign Application Priority Data

Dec. 24, 1994 [GB] United Kingdom ..... 9426247

[51] Int. Cl.[7] ..... B25B 17/00

[52] U.S. Cl. ..... 81/57.29; 81/58.1; 81/60; 81/62

[58] Field of Search ..... 81/57.29, 58.1, 81/60, 61, 62, 63.1

[56] References Cited

U.S. PATENT DOCUMENTS 4,545,267 10/1985 Shumway ..... 81/57.29
5,105,688 4/1992 Williams .

FOREIGN PATENT DOCUMENTS 0486710 5/1992 European Pat. Off. .
8803999 6/1988 WIPO .
92/07692 5/1992 WIPO .

*Primary Examiner*—Daivd A. Scherbel
*Assistant Examiner*—Joni B. Danganan
*Attorney, Agent, or Firm*—Robert W.J. Usher

[57] ABSTRACT

A ratchet wrench comprises an output drive member (13,17) rotatable about a first axis, a drive housing (15) containing the output drive member, and a handle (14) on the drive housing for rotating the drive housing about the first axis. A rotary member (24) within the handle is rotatable about a second axis and a drive ring (21) extends around the output drive member. A coupling means (25) couples the rotary member to the drive ring so that rotation of the rotary member about the second axis causes rotation of the drive ring about the output drive member. The wrench also includes primary ratchet means (17, 42) for selectively unidirectionally coupling the output drive member to the housing, and secondary ratchet means (23, 43) for selectively unidirectionally coupling the output drive member to the rotary member through the drive ring whereby the output drive member (13, 37) can be rotated in a selected direction either by rotation of the handle 14 or by rotation of the rotary member (24).

12 Claims, 4 Drawing Sheets

RATCHET WRENCH HAVING TWO MODES OF RECIPROCATING MANUAL INPUT

This invention relates to a ratchet wrench of the kind used for driving socket spanners and other similar devices for securing and releasing fasteners, such as for example nuts and bolts, by turning them.

Conventional ratchet wrenches are well known devices which essentially comprise a mechanism for transposing reciprocating circular arcuate movement of a handle into uni-directional rotation of a drive member for the purposes described above. The handle is usually an arm that extends radially outwardly from the axis of the drive member, most usually in a plane perpendicular to the drive member, although the arm can be cranked or jointed. The drive member normally has a projection such as a square drive shaft to be received in, for example, a fastener socket.

In addition to the arrangement described above, devices have been proposed which have dual means of producing rotation of the drive member. These may, for example, supplement conventional means of operation, using ratchet mechanisms, with rotary members on the handles, which when turned about the longitudinal axis of the handle also produce rotation of the drive member.

Such devices are particularly useful in confined spaces where conventional use of a wrench is difficult, especially if the torque required to rotate a fastener by hand is quite high, and the confined space means conventional use of the wrench would be very time-consuming. Conventional ratchet wrenches may also prove cumbersome when, for example, a nut and bolt assembly is incapable of providing the resistance required to enable the wrench to 'ratchet' or slip.

Many attempts have been made to develop on the basic concept of a ratchet wrench. Some involve complex mechanisms which may prove expensive to manufacture, and unreliable in operation. Others involve less complex designs, but accordingly do not offer the best advantage in operation.

U.S. Pat. No. 4,299,145 employs two counter-rotating ring gears positioned concentrically about an output drive member and a bevel gear drive pinion between them turned in either direction by a shaft through the wrench handle. Ratchet mechanisms for each ring gear ensure that the drive member rotates uni-directionally whatever the direction of rotation of the shaft, which is achieved by a spiral mechanism which transposes linear motion of a sleeve into rotary motion of the shaft.

A similar principle is disclosed in WO 92/07692, which employs very similar means except that rotation of the shaft is achieved by simply rotating the drive handle.

Both of these devices are capable of use in the conventional fashion, by turning the handle to and fro, whereupon the teeth on opposite sides of the bevel gear pinion act equally on the two ring gears and transmit torque to the drive member via the two ratchet mechanisms working to turn the ring gears, or slip, together.

U.S. Pat. No. 4,699,028 is an example of a less complex device. A conventional ratchet wrench is employed with a ratchet switch capable of decoupling the ratchet mechanism from the output drive member to permit the alternative mode of operation. This is also achieved by coupling one end of a rotatable shaft, extending through the wrench handle, to the drive member by a single bevel gear arrangement, and the other end of the shaft is coupled to a "spin knob" projecting from the end of the arm. In this arrangement there is no ratchet mechanism operating in the coupling between the "spin knob" and the output drive member. Therefore, if the direction of rotation of the "spin knob" is reversed the direction of rotation of the output drive member will also be reversed.

In the arrangement described in U.S. Pat. No. 2,206,802 a shaft in the handle of the wrench is coupled to the output drive member through two driven bevel gears each with an associated ratchet pawl. Rotation of the handle about the axis of the output drive member in either direction results in the output drive member rotating in the same direction by the action of the ratchet pawl. The shaft in the handle carries a continuous drive bevel gear which meshes with the two driven bevel gears. The teeth on the driven bevel gears are not continuous so that the shaft cannot be rotated continuously in one direction to rotate the output drive member. To rotate the output drive member the shaft in the handle is oscillated resulting in continuous rotation of the output drive member in one direction by the action of the ratchet pawls.

U.S. Pat. No. 4,592,256 describes a ratchet wrench in which a single ratchet pawl is used to control the rotation of the output drive member in a selected direction by rotation of the handle. The pawl is moved into a neutral position to allow for rotation of the output drive member by rotation of a shaft in the handle. Since the ratchet pawl is disconnected in its neutral position the direction of rotation of the output drive member is dependent on the direction of rotation of the shaft.

The limitation of the devices employing counter-rotating gears is their complexity, and sheer number of parts, some which may prove expensive and difficult to manufacture. Furthermore, all the torque is transmitted through the bevel gear pinion at all times, creating wear and durability problems. On the other hand the invention of U.S. Pat. No. 4,699,028 has to rely upon a very short spin knob to provide the alternative means of rotation since the knob is permanently coupled to the drive member for either mode of operation, and therefore has to be separate from the operator's grip used for conventional ratchet operation. If it were not short, the overall length of the handle would be excessive, but its shortness means that it does not offer the operator a particularly strong grip. In either case, the utility of the wrench is compromised.

U.S. Pat. No. 3,952,617 offers a further approach in which a rotatable shaft in the wrench handle is permanently connected to the drive member by bevel gearing, and a double ratchet arrangement in the handle between the rotatable shaft and a covering sleeve is controlled by a system of sliding wedges. Again, all the torque is always transmitted through the bevel gears.

U.S. Pat. No. 4,545,267 describes a wrench in which the primary ratchet drive is achieved by means of a pawl on the drive member cooperating with the splined interior of a housing at one end of the wrench handle. A rotatable sleeve on the wrench handle is provided for turning the drive member in the secondary ratchet mode, through the usual bevel gear connection, with the secondary ratchet being located inside the sleeve. However, three distinct decoupling devices are used, namely one at each of the two ratchets (their respective neutral positions) together with an arrangement for uncoupling the bevel gear which is needed to avoid the sleeve being turned when the wrench is used in its primary oscillating mode.

The present invention has for an object to provide a ratchet wrench with few parts that is capable of being reliable and advantageous in operation.

According to U.S. Pat. No. 4,545,267, it is known to provide a ratchet wrench comprising an output drive member rotatable about a first axis, a drive housing containing said output drive member, a handle on said drive housing for turning said drive housing about said first axis, a rotary member mounted on said handle and rotatable about a second axis, a drive ring extending around said output drive member inside the housing coupling means coupling rotation of said rotary member about said second axis with rotation of said drive ring about said first axis, primary ratchet means for selectively uni-directionally coupling said output drive member to said housing, and secondary ratchet means for selectively uni-directionally coupling said output drive member to said rotary member through said drive ring, whereby said output drive member can be rotated in a selected direction either by turning said handle about said first axis or by rotating said rotary member about said second axis.

According to the present invention, such a ratchet wrench may be characterised in that said drive ring is rotatable about said first axis with respect to said output drive member, and said secondary ratchet means is located between the drive ring and the output drive member.

The ratchet wrench of the invention can consequently couple the output drive member to the drive housing for operation by manually turning the handle to and fro, in conditions of maximum torque and where space allows, reserving operation by the rotary member through the drive ring for lower torques and/or lack of room to swing the handle. The rotary member may be located on the handle and turned or spun by finger and thumb action in a confined space or simply for rapid rotation of the drive member in low torque conditions. In preferred embodiments of the invention, as will be described, the secondary ratchet action in conjunction with the rotary member is effective even in conditions of low turn resistance in both directions, because the primary ratchet means can be arranged to lock the drive member against reverse rotation and so provide the necessary turn resistance to enable the secondary ratchet to slip.

The wrench may also comprise selector means adapted to switch either or both of the primary and secondary ratchet means to engage the drive member and turn it either clockwise or counterclockwise upon working the handle or the rotary member as the case may be. Selector means for both ratchet means may be linked whereby both ratchet means are switched together.

According to preferred aspects of the present invention the ratchet wrench has a drive housing from which a fixed arm extends as the handle. The drive member in the drive housing has an output drive axis which is perpendicular to the longitudinal axis of the wrench arm. The drive ring comprises a bevel ring gear positioned concentrically with the drive housing on the output drive axis. The rotary member comprises a sleeve over the arm coupled to a rotatable shaft extending coaxially through the arm, the inner end of which shaft is coupled to the ring gear by another bevel gear. The sleeve may be replaced by an alternative such as a knurled wheel or knob. The rotary member may also be power driven by motor means.

The primary ratchet means is normally located between the drive housing and the output drive member. The drive housing may have an internally splined cylindrical surface similar to that to be found in conventional ratchet wrenches, and a ratchet pawl may be mounted in the drive member.

The secondary ratchet means may be correspondingly located between the drive ring and the drive member. The drive ring may comprise an aperture shaped identically to that of the first drive means, and an outer surface, part of which is shaped as a bevel tooth gear, and part as a plain cylindrical surface.

In conventional operation the wrench arm is swung in the plane perpendicular to the output drive axis in the normal fashion. In a first direction the drive housing is coupled to the output drive member by the primary ratchet means engaging with the drive housing, and in the opposite direction the drive housing is decoupled from the output drive member as the ratchet mechanism 'ratchets' on the splined inner surface of the drive housing.

During this mode of operation the drive ring rotates with the output drive member in the driving direction, such that the sleeve on the drive handle remains stationary; whilst in the reverse direction, a force proportional to the resistance of the secondary ratchet mechanism will be imparted to the drive shaft and sleeve on the handle which can easily be resisted to prevent the drive member from rotating.

Alternative operation is achieved by turning the sleeve, and accordingly the inner shaft to the handle, on the longitudinal axis of the wrench arm. In the driving direction the shaft is coupled to the output drive member by the drive ring, with the secondary ratchet means engaged, and in the opposite direction the sleeve is decoupled from the output drive member as the latter 'ratchets' over the splines of the drive ring.

During this mode of operation the drive housing 'ratchets' with the output drive member in the driving direction of rotation of the rotary member; and in the reverse direction, the primary ratchet means engages the drive member with the drive housing whilst the ring gear 'ratchets'. This feature is advantageous when a loose fastener is involved.

Additionally, the arrangement of the present embodiment is such that the highest forces imparted to the wrench are transmitted through the body, or drive housing, only, in the same manner as conventional wrenches, and not through the bevel gears. By contrast, more complex known devices require such loads to be transmitted through a plurality of complex components including gear teeth. Conversely, more simple devices often require a switching act to change between the different modes of operation, or have no 'ratchetting' provision whatsoever for non-conventional operation. Whilst this may not prove a problem when, for example, a nut and bolt assembly is loose, it may well do so when the resistance offered is greater, especially if that resistance is intermittent.

A specific embodiment of a ratchet wrench in accordance with the invention will now be described by way of example with reference to the accompanying drawings, in which.

Figure 1:
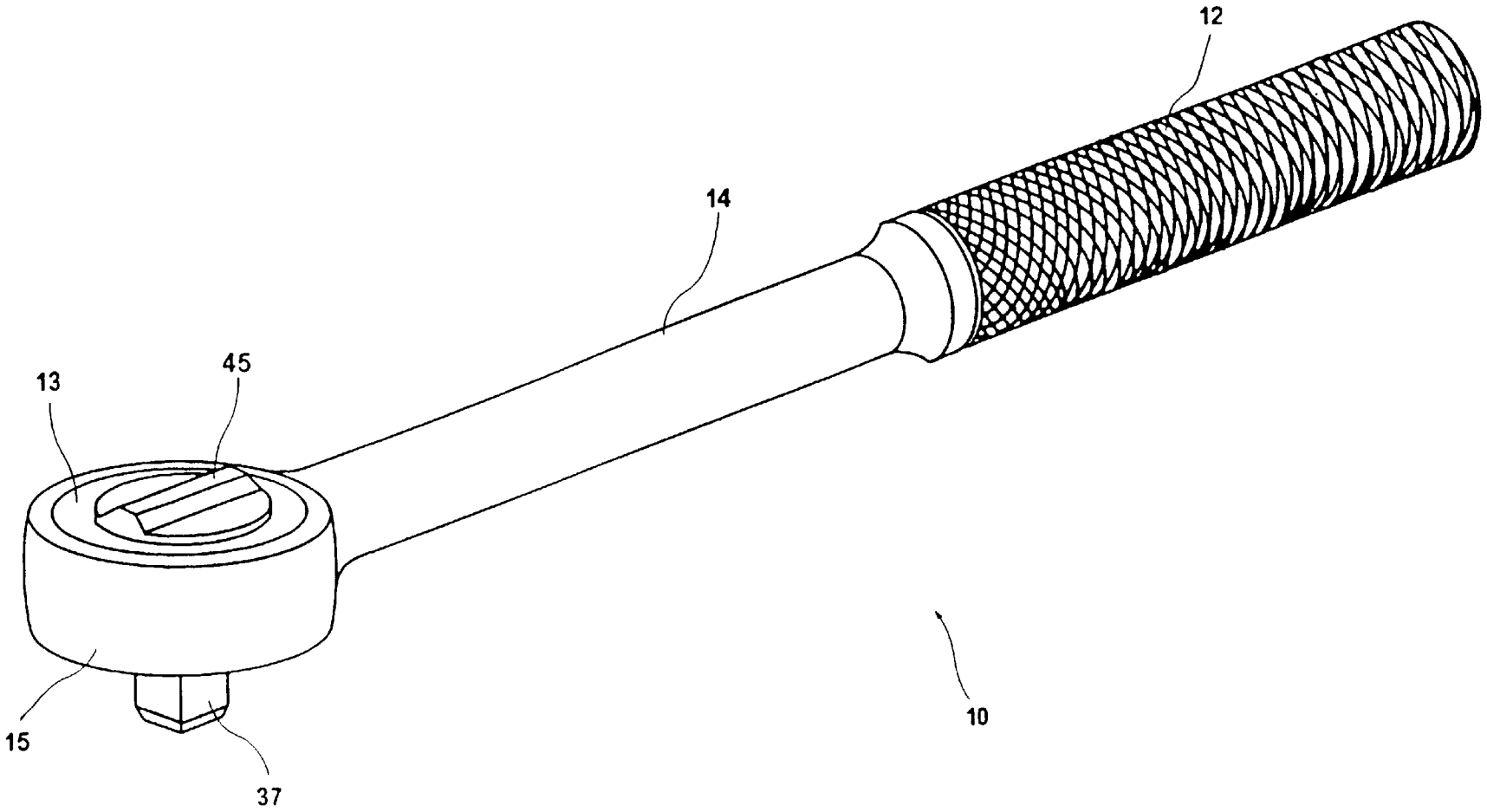
FIG. 1 is a perspective illustration of a preferred embodiment of ratchet wrench.
Figure 2:
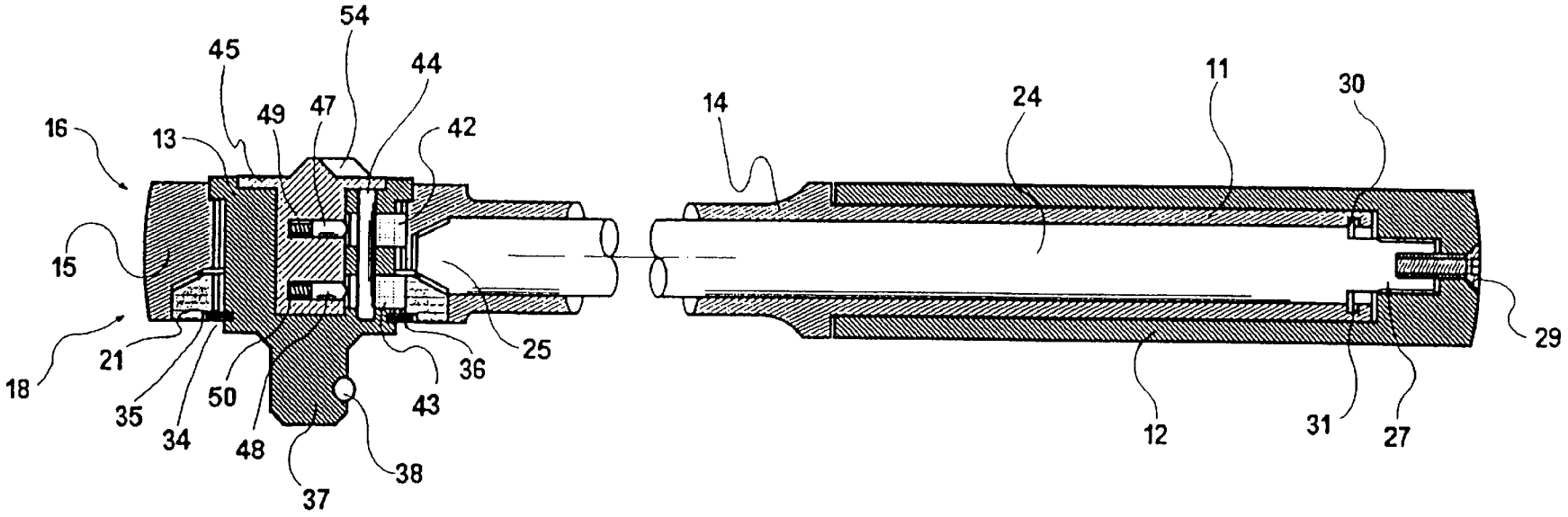
FIG. 2 is a partial cross sectional side elevation of the wrench.
Figure 3:
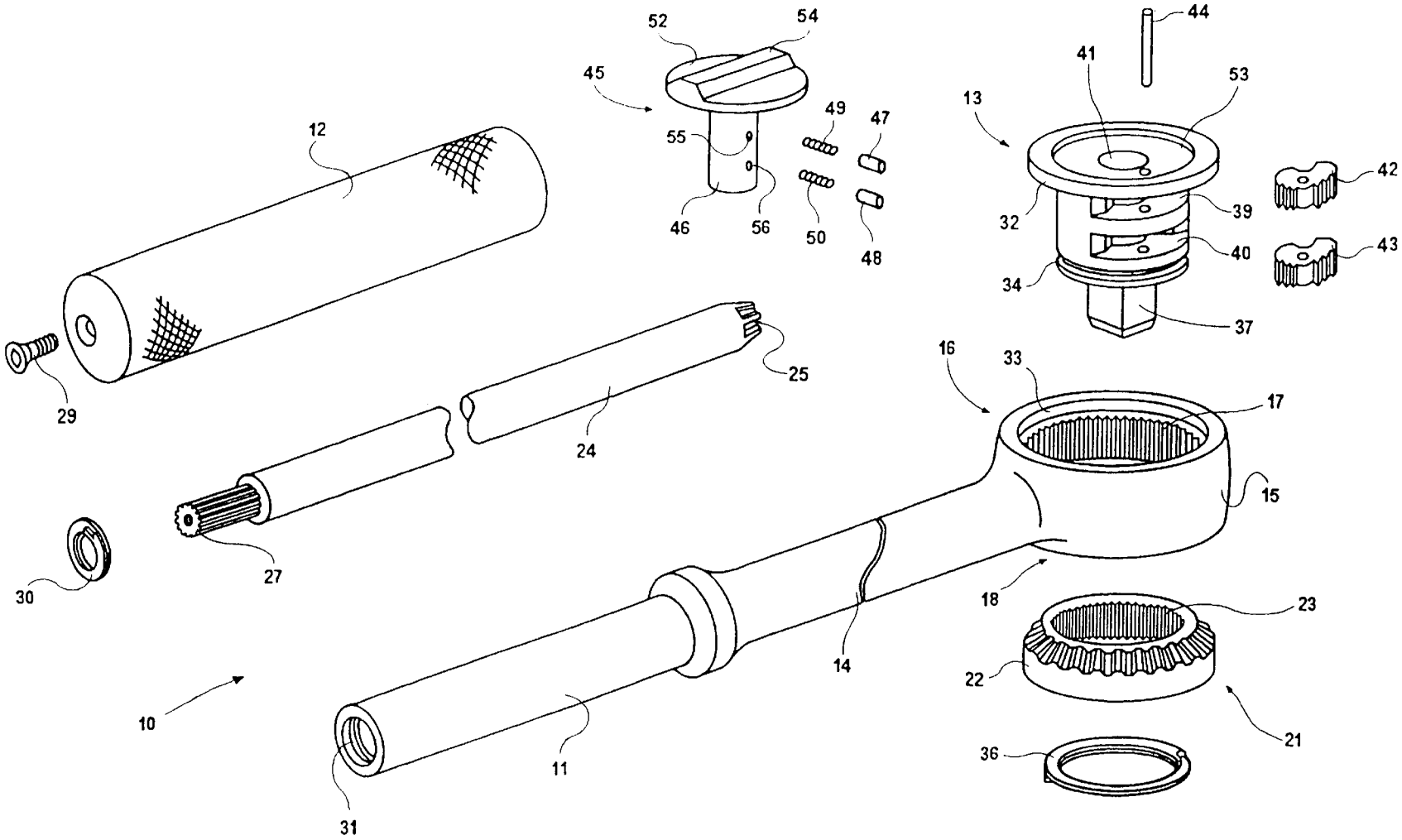
FIG. 3 is an exploded perspective illustration of the wrench.

As shown in the drawings, wrench 10 comprises a handle 11 comprising a knurled sleeve 12 on a fixed arm 14 which extends in a plane perpendicular to the longitudinal axis of a drive housing 15. An upper portion 16 of the housing has a splined cylindrical inner surface 17, whilst a lower portion 18 comprises a plain concentric cylindrical inner surface 19, below a concentric frusto-conical shoulder 20.

A bevel drive ring gear 21 comprises a plain cylindrical outer surface 22, and a concentric bore which has a splined cylindrical surface 23 that is in this case dimensionally identical to that of the upper portion of the housing. The ring gear is located within the lower housing portion 18 such that it rotates freely and concentrically therein.

Figure 4:
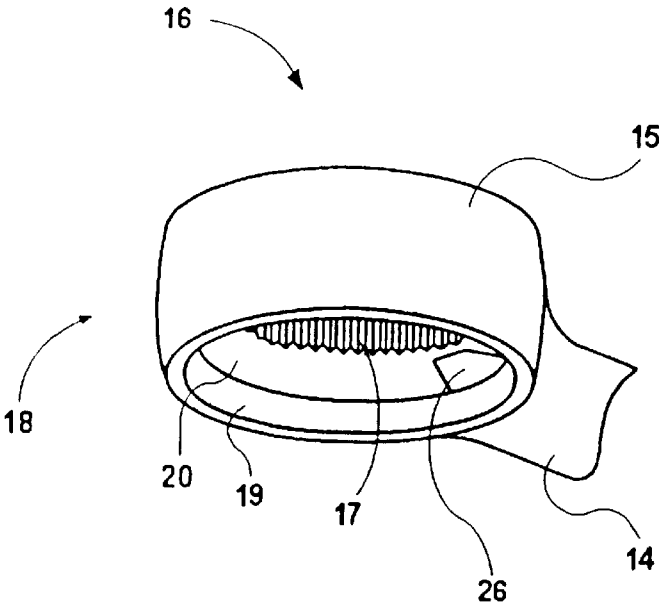
FIG. 4 is a perspective view of the underside of the wrench drive housing.

The arm 14 is a cylindrical tube integral with the drive housing in which a rotatable shaft 24 is mounted. The inner end of the shaft is adapted to form a bevel pinion gear 25 which fits closely against a tapered inner end to the tubular arm 14 located directly adjacent drive housing 15. Furthermore the position of the taper is such that an aperture 26 is formed on conical shoulder 20 of the housing lower portion 18, as best seen in FIG. 4, to allow the pinion bevel gear to mesh with the bevel ring gear 21. The taper is located such that it does not intrude into splined cylindrical inner surface 17 of the upper portion of the drive housing.

The outer end of the shaft 24 extends beyond the arm 14, and is provided with a splined projection 27 coupled to handle sleeve 12, and retained by a screw 29 or other suitable fastener. The shaft is retained in position by a sprung circlip 30 which locates in an undercut 31 inside the arm. Sleeve 12 serves as a rotary member coupled by the shaft 24 and the bevel pinion gear 25 to the bevel drive ring gear 21.

An output drive member 13 is positioned for concentric rotation within the drive housing and drive ring, by upper flange 32 which locates in recess 33 above the housing upper portion 16. An undercut 34 is provided at the opposite lower end of the drive member for alignment with a recess 35 on the lower face of ring gear 21 such that a sprung fastener 36 retains both components in housing 15. A polygonal projection 37, in this case a standard square drive stud, incorporating a spring-loaded ball 38, extends from the drive member for coupling to a conventional drive socket or other device to be turned by the wrench.

The output drive member 13 also carries the primary and secondary ratchet means. These comprise upper and lower slots 39, 40, which intersect with a cylindrical axial aperture 41, and two pawls 42, 43, which are retained in the slots by pin 44 such that the pawls pivot for simultaneous, but independent engagement with the splined inner surfaces of the upper portion of the housing, in the case of the primary ratchet, and of the drive ring gear, in the case of the secondary ratchet. The pivotal position of the pawls is determined by a selector switch 45 in the axial aperture 41 comprising a finger grip 54 on an upper plate 52, a spindle 46, bearing pins 47, 48, and springs 49, 50.

The switch spindle 46 is positioned for rotation in aperture 41 with upper plate 52 located in a corresponding recess 53 on the drive member. The two bearing pins 47, 48 project from the spindle such that they press on the inward facing surfaces of pawls 42, 43. The pins are aligned to urge the pawls to pivot simultaneously in the same direction by springs 49, 50, which underlie the pins in holes 55, 56, on the spindle. The switching limits of the spindle are effected by the bearing pins touching the sides of slots 39, 40, whereas the top surface of each slot retains the entire selector mechanism in the drive member.

In operation wrench 10 may be used in a conventional or primary mode, a non-conventional or secondary mode, or a combination of these modes as hereinafter described.

In the primary mode of operation handle 11 is swung in either direction about the output drive axis. In one direction the primary ratchet mechanism couples drive housing 15 to drive member 13 via upper pawl 42 and splined inner surface 17, to cause an output rotation of the drive member in the same direction, whilst in the secondary ratchet mechanism lower pawl 43 engages the splined inner surface 23 of the ring gear 21, but neither drives nor slips, since these elements rotate in unison with the wrench so long as rotary sleeve 12 does not turn on the handle 11. In the opposite direction the primary ratchet mechanism decouples drive member 13 from the housing 15 such that no rotation of the drive member occurs, provided of course that there is sufficient turn resistance from the fastener to which the drive member is connected, whilst the secondary ratchet mechanism including lower pawl 43 decouples the drive ring 21 from drive member 13.

Thus it will be understood that in the first direction no movement between ring gear 21 and shaft 24 takes place so handle sleeve 12 remains stationary. In the reverse direction a small force proportional to the resistance of the secondary ratchet mechanism will be imparted to the handle, but will be overcome as the lower pawl spring 50 yields.

In the secondary mode of operation sleeve 12 is twisted in either direction about the longitudinal axis of arm 14. In one direction the secondary ratchet mechanism couples the splined inner surface 23 of the drive ring 21 to drive member 13 via lower pawl 43 to cause an output rotation of the drive member in the same direction, whilst upper pawl 42 of the primary ratchet decouples the drive member from the splined inner surface 17 of the drive housing. In the reverse direction the secondary ratchet mechanism decouples drive member 13 from ring gear 21, whilst upper pawl 42 couples the splined surface 17 to drive member 13 such that the drive member is prevented from rotating in the 'ratchetting direction' by any residual forces imparted by the drive ring on the slipping pawl 43.

Thus it will be understood that in the reverse 'ratchetting' direction, because drive member 13 is held stationary by drive housing 15 whilst sleeve 12 is being turned, the tendency for very loose fasteners to cause the wrench not to ratchet is overcome. Furthermore it is possible to use the wrench in a combination of both modes whereby twisting sleeve 12 at the same time as swinging arm 14 will speed up the rotation of drive member 13 in the positive direction.

Whilst the invention has been described in detail many alterations and modifications may be made within the scope thereof.

What is claimed is:

1. A ratchet wrench for transmitting two modes of reciprocating manual input motion imparted to a handle into one rotary output motion, in which the two modes of reciprocating manual input motion are a primary mode consisting of manually turning said handle to and fro about a first axis, and a secondary mode consisting of manually rotating a rotary member to and fro on said handle about a second axis intersecting said first axis, comprising:

an output drive member rotatable about a first axis, a drive housing containing the output drive member, a handle on said drive housing for turning said drive housing about a first axis, a rotary member mounted on said handle exposed for manual rotation about a second axis intersecting said first axis, a drive ring extending around said output drive member inside the housing, coupling means coupling rotation of said rotary member about said second axis with rotation of said drive ring about said first axis, primary ratchet means for selectively uni-directionally coupling said output drive member to said housing, and secondary ratchet means for selectively uni-directionally coupling said output drive member to said rotary member through said drive ring, whereby said output drive member can be rotated in a selected direction either by manually turning said handle to and fro about said first axis or by manually rotating said rotary member to and fro about said second axis;

wherein said drive ring is rotatable about said first axis with respect to said output drive member, and said secondary ratchet means is located between the drive ring and the output drive member.

2. A ratchet wrench as claimed in claim 1 wherein said secondary ratchet means comprises a splined internal cylindrical surface on said drive ring and an adjustable pawl cooperating with said splined cylindrical surface.

3. A ratchet wrench as claimed in claim 2 wherein said primary ratchet means comprises a splined internal cylindrical surface on said drive housing and an adjustable pawl cooperating with said splined cylindrical surface on said drive housing, and both the primary pawl and the secondary pawl are carried on said output drive member.

4. A ratchet wrench as claimed in any one of claims 1 to 3 wherein said handle comprises a cylindrical tubular arm, said rotary member comprises a shaft extending down said tubular arm, said shaft extends towards said splined internal cylindrical surface on said drive ring, and said coupling means is provided at an inner end of said shaft.

5. A ratchet wrench as claimed in any one of claims 1 to 3 wherein said drive ring comprises a bevel gear positioned concentrically within said drive housing, said handle comprises a cylindrical tubular arm, said rotary member comprises a shaft extending down said tubular arm, and said coupling means comprises a bevel pinion on said shaft inside an end thereof and, in both primary and secondary modes of operation, engaged with said bevel gear through an aperture in said end.

6. A ratchet wrench as claimed in any one of claims 1 to 3 wherein, in both primary and secondary modes of operation, said coupling means couples said rotary member to said drive ring, and said output drive member is always rotatable in the selected direction both by manually turning said handle about said first axis and by manually rotating said rotary member about said second axis.

7. A ratchet wrench as claimed in any one of claims 1 to 3, wherein said rotary member on said handle comprises a manually rotatable sleeve extending outside a cylindrical fixed arm portion of said handle.

8. A ratchet wrench as claimed in claim 3 wherein said primary and secondary ratchet means comprise linked selector means for simultaneously switching both of said primary and secondary ratchet means to engage said output drive member so as to rotate said output drive member in a selected one of two directions under the action of either said handle or said rotary member.

9. A ratchet wrench as claimed in claim 2 wherein said primary and secondary ratchet means comprise linked selector means for simultaneously switching both of said primary and secondary ratchet means to engage said output drive member so as to rotate said output drive member in a selected one of two directions under the action of either said handle or said rotary member.

10. A ratchet wrench as claimed in claim 1 wherein said primary and secondary ratchet means comprise linked selector means for simultaneously switching both of said primary and secondary ratchet means to engage said output drive member so as to rotate said output drive member in a selected one of two directions under the action of either said handle or said rotary member.

11. A ratchet wrench as claimed in claim 10 wherein said primary and secondary ratchet means respectively comprise a primary pawl and a secondary pawl mounted on said drive member, and the linked selector means comprise a spindle mounted in an axial aperture within the drive member and carrying means for urging the said pawls to pivot between two operative positions corresponding to respective rotary positions of the spindle.

12. A ratchet wrench for transmitting two modes of reciprocating manual input motion imparted to a handle into one rotary output motion, in which the two modes of reciprocating manual input motion are a primary mode consisting of manually turning said handle to and fro about a first axis, and a secondary mode consisting of manually rotating a sleeve on said handle to and fro about a second axis intersecting said first axis, comprising:

an output drive member rotatable about a first axis, a drive housing containing said output drive member, a handle comprising a cylindrical tubular arm fixed on said drive housing for manually turning said drive housing about said first axis, a sleeve mounted on said handle outside said fixed arm portion thereof and manually rotatable about a second axis intersecting said first axis, a drive ring extending around said output drive member inside the housing, coupling means coupling rotation of said sleeve about said second axis with rotation of said drive ring about said first axis, primary ratchet means for selectively uni-directionally coupling said output drive member to said housing, and secondary ratchet means for selectively uni-directionally coupling said output drive member to said sleeve through said drive ring, whereby said output drive member can be rotated in a selected direction either by manually turning said handle to and fro about said first axis or by manually rotating said sleeve to and fro about said second axis;

wherein said drive ring comprises a bevel gear positioned concentrically within said drive housing and rotatable about said first axis with respect to said output drive member, said secondary ratchet means is located between the drive ring and the output drive member, said sleeve is mounted on a shaft extending down said tubular arm, and said coupling means comprises a bevel pinion on said shaft inside an end thereof and, in both primary and secondary modes of operation, engaged with said bevel gear through an aperture in said end.

* * * * *